US011543764B2

(12) United States Patent
Murata

(10) Patent No.: US 11,543,764 B2
(45) Date of Patent: Jan. 3, 2023

(54) IMAGE FORMING APPARATUS

(71) Applicant: CANON KABUSHIKI KAISHA, Tokyo (JP)

(72) Inventor: Naofumi Murata, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/386,691

(22) Filed: Jul. 28, 2021

(65) Prior Publication Data

US 2022/0043378 A1 Feb. 10, 2022

(30) Foreign Application Priority Data

Aug. 4, 2020 (JP) ..... JP2020-132267

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 10,928,756 B1 * 2/2021 Araki ..... G03G 15/2053

FOREIGN PATENT DOCUMENTS

| | | | |
|---|---|---|---|
| JP | 2002296961 | A | 10/2002 |
| JP | 2003302875 | A | 10/2003 |
| JP | 2007017675 | A | 1/2007 |
| JP | 2007025082 | A | 2/2007 |
| JP | 2008191388 | A | 8/2008 |

* cited by examiner

*Primary Examiner* — Clayton E. LaBalle
*Assistant Examiner* — Michael A Harrison
(74) *Attorney, Agent, or Firm* — Rossi, Kimms & McDowell LLP

(57) ABSTRACT

An image forming apparatus is provided, which includes an image forming unit that forms a toner image on a recording material, a fixing unit that heats the recording material and fixes the toner image onto the recording material, and a heating-temperature control unit that controls a temperature of the fixing unit, and which performs an image forming operation of forming the toner image and fixing the toner image onto the recording material. In a case of performing the image forming operation a plurality of times, the heating-temperature control unit performs control such that the temperature of the fixing unit is a first temperature when performing the image forming operation a first number of times and that the temperature of the fixing unit is a second temperature when performing the image forming operation a second number of times.

11 Claims, 16 Drawing Sheets

IMAGE FORMING APPARATUS

BACKGROUND OF THE INVENTION

Field of the Invention

The present invention relates to an image forming apparatus.

Description of the Related Art

Image forming apparatuses such as various types of printers, photocopiers, and so forth, which employ electrophotographic systems, are on the market. Generally, image forming apparatuses using electrophotographic systems form a toner image by a developing process, and transfer the formed toner image onto a recording material such as a sheet or the like. The sheet is thereafter heated and pressurized, whereby processing of fixing the image is performed. The sheet that is subjected to fixing processing is subsequently discharged onto a stacking tray by a sheet discharge transporting device that has a sheet discharge roller, and is stacked. An issue called "discharged-sheet sticking" is known to occur at the time of stacking sheets onto the tray.

This discharged-sheet sticking is a phenomenon in which discharged sheets stick to each other in a case where the temperature is high enough for toner images on stacked sheets to soften. In a case of simplex printing with the printed faces of the sheets facing toward the tray (face-down discharge), the rear face of a preceding sheet that has been stacked and the toner image face of a following sheet stick to each other. In a case of the printed faces of the sheets facing away from the tray (face-up discharge), the toner image face of a preceding sheet that has been stacked and the rear face of a following sheet stick to each other. Also, in a case of duplex printing, the toner images of the sheets stick to each other. In a case of such discharged-sheet sticking occurring, there is a possibility of toner images peeling off when a user retrieves the sheets from the stacking tray, resulting in defective images.

Various types of measures for discharged-sheet sticking have been conventionally studied. First, there is a method in which the sheet interval time is lengthened during the job, thereby extending the amount of time of sheets being cooled on the tray. There also is a method of lowering the fixing temperature to lower the temperature of sheets stacked on the tray. There further is a method of blowing air from a fan onto toner image faces of the sheets following fixing processing, to cool the toner image faces of the sheets.

For example, Japanese Patent Application Laid-open No. 2002-296961 describes sheet interval control of sheets in continuous printing. Also, Japanese Patent Application Laid-open No. 2003-302875 describes control in accordance with sheet temperature following discharge.

SUMMARY OF THE INVENTION

However, lengthening the sheet interval time during the job reduces productivity (the number of prints that can be printed per unit time). Also, lowering the fixing temperature lowers fixing performance, and there is a possibility that image defects will occur. Further, providing a fan for cooling leads to increased size of the apparatus and to increased manufacturing costs.

The present invention has been made with the forgoing issue in view, and accordingly it is an object thereof to provide technology for suppressing discharged-sheet sticking in an image forming apparatus.

The present invention provides an image forming apparatus comprising:

an image forming unit that forms a toner image on a recording material;

a fixing unit that heats the recording material and fixes the toner image onto the recording material; and a heating-temperature control unit that controls a temperature of the fixing unit, the image forming apparatus performing an image forming operation of forming the toner image and fixing the toner image onto the recording material, wherein in a case of performing the image forming operation a plurality of times, the heating-temperature control unit performs control such that the temperature of the fixing unit is a first temperature when performing the image forming operation a first number of times and that the temperature of the fixing unit is a second temperature when performing the image forming operation a second number of times, and the second number of times is greater than the first number of times, and the second temperature is higher than the first temperature.

According to the present invention, technology can be provided for suppressing discharged-sheet sticking in an image forming apparatus.

Further features of the present invention will become apparent from the following description of exemplary embodiments with reference to the attached drawings.

DESCRIPTION OF THE EMBODIMENTS

Forms for carrying out the present invention will be exemplarily be described in detail in the following description, with reference to the figures and embodiments. Note however, that functions, materials, dimensions, and shapes of components, and the relative layout thereof, and so forth, described in the embodiments do not limit the scope of the present invention thereto unless specifically stated so. Also, with regard to members described once in the following description, the functions, materials, dimensions, shapes, relative layout thereof, and so forth, are the same as in the first description unless specifically stated otherwise. In a case of performing image forming operations a plurality of number of times, a heating-temperature control unit of an image forming apparatus performs control so that a temperature of a fixing unit is a first temperature when performing an image forming operation a first number of times, and the temperature of the fixing unit is a second temperature when performing the image forming operation a second number of times, which will be described in detail later. Control is performed such that the second number of times is greater than the first number of times, and the second temperature is higher than the first temperature.

Embodiment 1

A feature of Embodiment 1 is raising a fixing temperature in stages in accordance with the number of prints in a job, in a case of forming images by an automatic duplex printing image forming apparatus. This improves fixing performance of images, and suppresses sticking. Note that the term "printing" in the following description does not limit the object of application thereof to printing of text. The method of the present embodiment is applicable to various objects, such as text, shapes photographs, and so forth. Also note that the recording material is not limited to paper.

Configuration of Image Forming Apparatus

Figure 1:
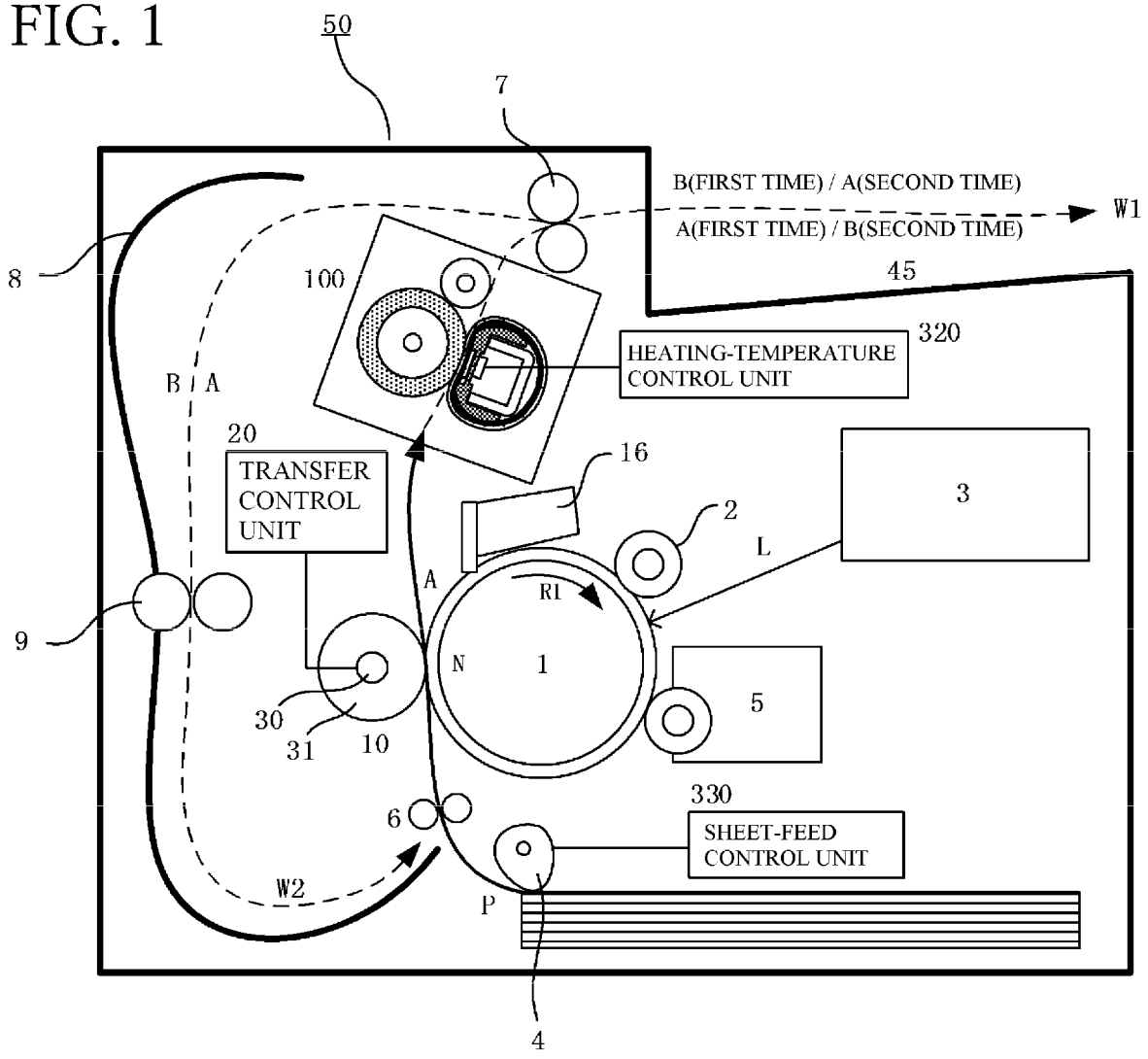
FIG. 1 is a cross-sectional view illustrating a configuration of an image forming apparatus.

A configuration of an image forming apparatus 50, and a method of forming an unfixed toner image on a recording material, will be described with reference to a schematic cross-sectional view in FIG. 1. The image forming apparatus 50 is an image forming apparatus according to an electrophotography system, in which a toner image on a photosensitive drum is directly transferred onto a recording material P.

Disposed along a circumferential face of a photosensitive drum 1 that is an image bearing member is, in order following a rotation direction (direction of an arrow R1), a charging device 2, an exposing device 3 that irradiates the photosensitive drum 1 by laser light L, a developing device 5, a transfer roller 10, and a photosensitive drum cleaner 16. These can also be referred to as an image forming unit that forms and transfers toner images onto the recording material P.

First, the charging device 2 charges the surface of the photosensitive drum 1 to a negative polarity. The exposing device 3 then irradiates the surface of the charged photosensitive drum 1 by laser light L. Thus, the surface potential of exposed portions rises, and an electrostatic latent image is formed. The developing device 5 contains toner (black toner here) charged to a negative polarity, and a toner image is formed on the photosensitive drum 1 by this toner adhering to the electrostatic latent image portion on the photosensitive drum 1. Note that the image forming apparatus may have a plurality of photosensitive drums corresponding to toner of a plurality of colors (e.g., yellow, magenta, cyan, and black) used for forming color images. In this case, the image forming apparatus superimposes images of each of the colors on the recording material P to form color images.

The recording material P is fed by a sheet feeding roller 4, of which the sheet-feed timing is controlled by a sheet-feed control unit 330, and is transported to a transfer nip portion N by transport rollers 6. A transfer bias of a positive polarity, which is opposite to the polarity of the toner, is applied to the transfer roller 10 from a transfer control unit 20. Accordingly, the toner image on the photosensitive drum 1 is transferred to a face A (first face) of the recording material P at the transfer nip N portion. The photosensitive drum cleaner 16 has an elastic blade, which removes transfer residual toner from the surface of the photosensitive drum 1 after transfer.

The recording material P bearing the toner image on the face A thereof is transported to a heating device 100, of which a fixing temperature is adjusted by a heating-temperature control unit 320. The heating device 100 heats and fixes the toner image on the face A of the recording material P. The recording material P that has passed through the heating device 100 is sent to discharge rollers 7, and is sent in the direction of an arrow W1 in FIG. 1. Once heating and fixing is completed to the trailing end of the recording material P, the discharge rollers 7 are reversed by switching means omitted from illustration, and the recording material P is sent in the direction of an arrow W2 in FIG. 1. Next, the recording material P passes through a duplex guide 8, and is sent to the transport rollers 6 again by duplex rollers 9. Accordingly, the front and rear of the recording material P have been reversed from when printing the face A.

Next, image transfer to a face B (second face), which is the rear face of the recording material P, is performed. The heating device 100 then fixes the toner image onto the face B. The recording material P is then sent to the discharge rollers 7 again. The discharge rollers 7 discharge the recording material P that has toner images fixed on both faces, to a discharge tray 45. Accordingly, when stacked on the discharge tray 45, the face A of the recording material P is in a state facing upward, and the face B facing downward. Printed recording material P is continuously stacked on the discharge tray 45 serving as a recording material stacking unit for a plurality of times.

Heating Device

Next, the heating device 100 will be described with reference to a cross-sectional view in FIG. 2. In the present embodiment, a film heating system heating device 100, which is capable of reducing startup time and reduced electric power consumption, is used. The heating device 100 is a fixing unit that fixes toner images on recording material.

The heating device 100 has a configuration provided with a fixing film 112 that has flexibility and is cylindrical in shape, and a pressure-applying roller 110. Provided within the fixing film 112 is a heater unit 160 having a configuration in which a heating heater 113 is held by a heater holder 130. The heater holder 130 preferably is formed of a material with a low thermal capacity, to draw heat away from the heating heater 113 less readily. In the present embodiment, liquid crystal polymer (LCP) that is a heat-resistant resin was used. The heater holder 130 is supported by an iron stay 120 from the opposite side from the heating heater 113, to impart strength thereto. The stay 120 is pressured in the direction of an arrow A2 in FIG. 2 by a pressing spring (omitted from illustration), at both end portions in a direction orthogonal to the transportation direction of the recording material P. The heating heater 113 comes into contact with the inner face of the fixing film 112 to form an inner-face nip Ni, and heats the fixing film 112 from the inner side.

The pressure-applying roller 110 is disposed facing the heating heater 113 across the fixing film 112. The pressure-applying roller 110 forms a fixing nip No with the fixing film 112. Upon the pressure-applying roller 110 being driven in the direction of an arrow R1 in FIG. 2 by driving force of a driving source (omitted from illustration), the fixing film 112 is rotationally driven in the direction of an arrow R2 under force from the pressure-applying roller 110 at the fixing nip No.

Figure 2:
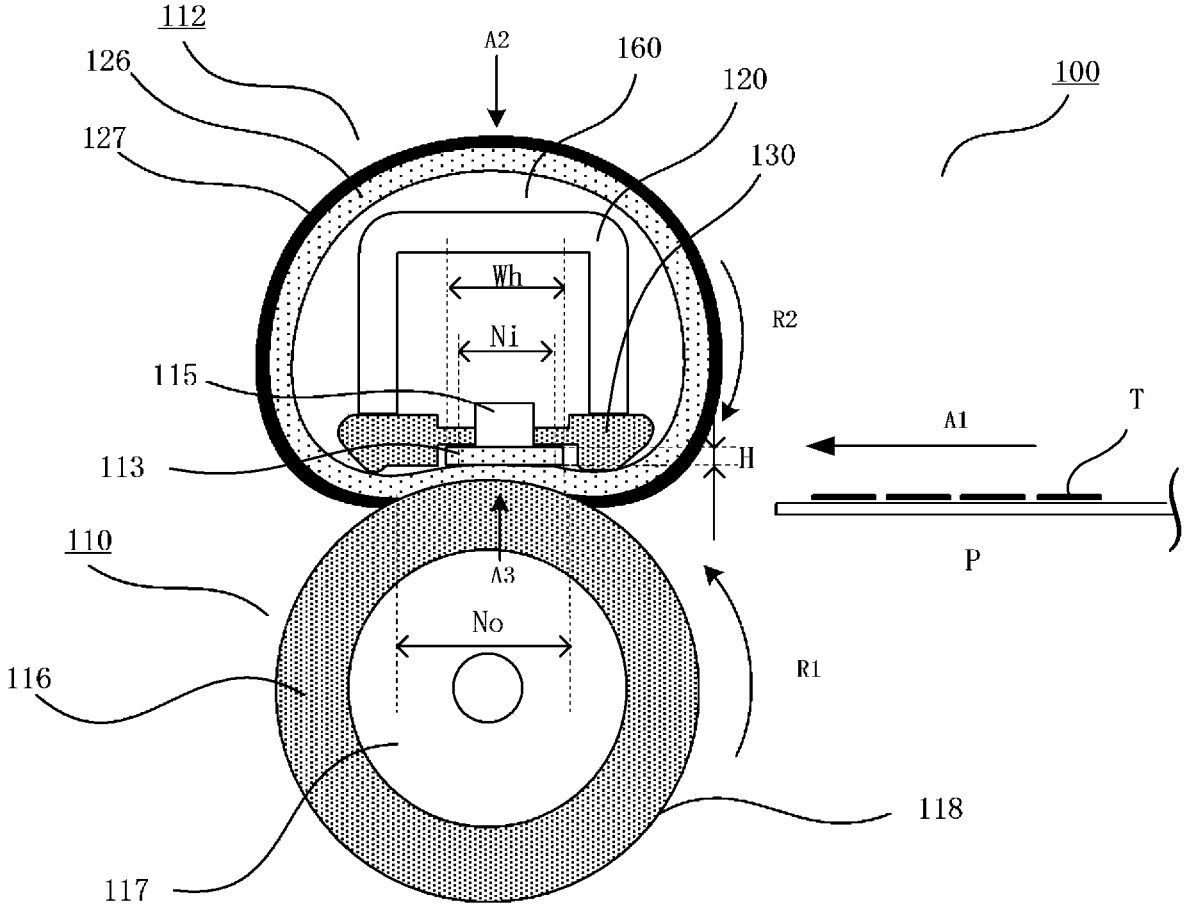
FIG. 2 is a cross-sectional view illustrating the way in which recording material is transported to a heating device.

The recording material P onto which an unfixed toner image T is transferred is transported from the direction of an arrow A1 in FIG. 2, and is sent into the fixing nip No. The toner image T on the recording material is then heated by the heating heater 113, and the image is fixed onto the recording material P.

Fixing Film

The fixing film 112 has a cylindrical shape that is 20 mm in outer diameter, in a non-deformed state. The fixing film 112 has a multi-layer configuration including a base layer 126 for maintaining strength of the film, and a release layer 127 for reducing adhesion of contaminants to the surface.

The base layer 126 needs to have heat resistance as to the heat from the heating heater 113, and also needs strength for sliding against the heating heater 113. Accordingly, the material of the base layer 126 preferably is a metal such as stainless used steel (SUS), nickel, or the like, or a heat-resistant resin such as polyimide or the like. Metal has advantages such as being able to be formed thin due to being strong, being able to readily transmit heat from the heating heater 113 to the surface of the fixing film due to having high thermal conductivity, and so forth. Resin has advantages such as warming easily due to having a smaller thermal capacity as compared to metal, being able to be inexpensively formed by coat molding, and so forth. In the present embodiment, a material obtained by adding a carbon filler to polyimide resin to improve thermal conductivity and strength was used for the base layer 126. The thickness of the base layer 126 preferably is around 15 μm to 100 μm from the perspective of balance of strength and thermal conductivity, and was set to 50 μm in the present embodiment.

The material of the release layer 127 preferably is a fluororesin such as perfluoroalkoxy resin (PFA), polytetrafluoroethylene resin (PTFE), tetrafluoroethylene-hexafluoropropylene resin (FEP), and so forth. PFA has excellent release characteristics and thermal resistance, and accordingly was used in the present embodiment. The release layer 127 is preferably formed by covering the surface of the base layer in the form of a tube, or coating the surface thereof with a coating material. Coating was used in the present embodiment, as coating is superior in the ability to form thinly. The release layer 127 preferably is around 5 μm to 30 μm from the perspective of balance of durability and thermal conductivity, and was set to 10 μm in the present embodiment.

Pressure-Applying Roller

The pressure-applying roller 110 according to the present embodiment has a configuration in which a 4-mm thick elastic layer 116 (foamed rubber) made by foaming silicon rubber is formed on an iron core 117 that is 12 mm in diameter. If the thermal capacity of the pressure-applying roller 110 is great, heat at the surface of the pressure-applying roller 110 is readily absorbed to the inside, and the surface temperature does not readily rise. Accordingly, the rise time of the surface temperature of the pressure-applying roller 110 can be shortened by using a material that has maximally low thermal conductivity with low thermal capacity, and high thermal insulation effects. The thermal conductivity of the aforementioned foamed rubber made by foaming silicon rubber is 0.11 to 0.16 W/m·K, which is lower than the terminal conductivity of solid rubber, which is around 0.25 to 0.29 W/m·K. Also, while the specific gravity as to thermal capacity is approximately 1.05 to 1.30 for solid rubber, foamed rubber exhibits low thermal capacity at approximately 0.45 to 0.85. As described above, foamed rubber used in the present embodiment can reduce the rise time of the surface temperature of the pressure-applying roller 110.

The outer diameter of the pressure-applying roller 110 was set to 20 mm, from the perspective of balance between suppressing thermal capacity and securing the width of the fixing nip No. The elastic layer 116 needs a suitable thickness to prevent heat from escaping to the metal core, and was set to 4 mm in the present embodiment. A release layer 118, made of perfluoroalkoxy (PFA) resin, is formed upon the elastic layer 116, for release of toner. Note that fluororesins such as PTFE, FEP, and so forth, fluorine rubber or silicon rubber with good release characteristics, or the like, may be used for the release layer 118. The surface hardness of the pressure-applying roller 110 is decided from the perspective of balance between durability, and securing the width of the fixing nip at a low pressure by setting the hardness to be low, and was set to 40° on the Asker C hardness scale (load 4.9 N) in the present embodiment. The pressure-applying roller 110 rotates at a surface movement speed of 200 mm/sec in the direction of the arrow R1 in FIG. 2, by rotational means omitted from illustration.

Heating Heater

The heating heater 113 according to the present embodiment has resistance heaters arrayed in serially on a ceramic substrate. The heating heater 113 is fabricated by coating silver-palladium (Ag—Pd) resistance heaters to a thickness of 10 μm by screen printing on the surface of an alumina substrate 6 mm in width Wh in the direction of transportation of the recording material, and 1 mm in thickness H, and covering thereupon with glass to a thickness of 50 μm, as a heater protective layer. The resistance heaters generate heat under application of electricity from an electrode portion (omitted from illustration). A temperature detecting element 115 that detects the temperature of the ceramic substrate rising in accordance with heat generated by the resistance heaters is disposed on the rear face of the heating heater 113. The temperature of the heating heater 113 can be adjusted by the heating-temperature control unit 320 controlling electric current applied to the resistance heaters in accordance with signals from the temperature detecting element 115.

Printer Control Device

Figure 3:
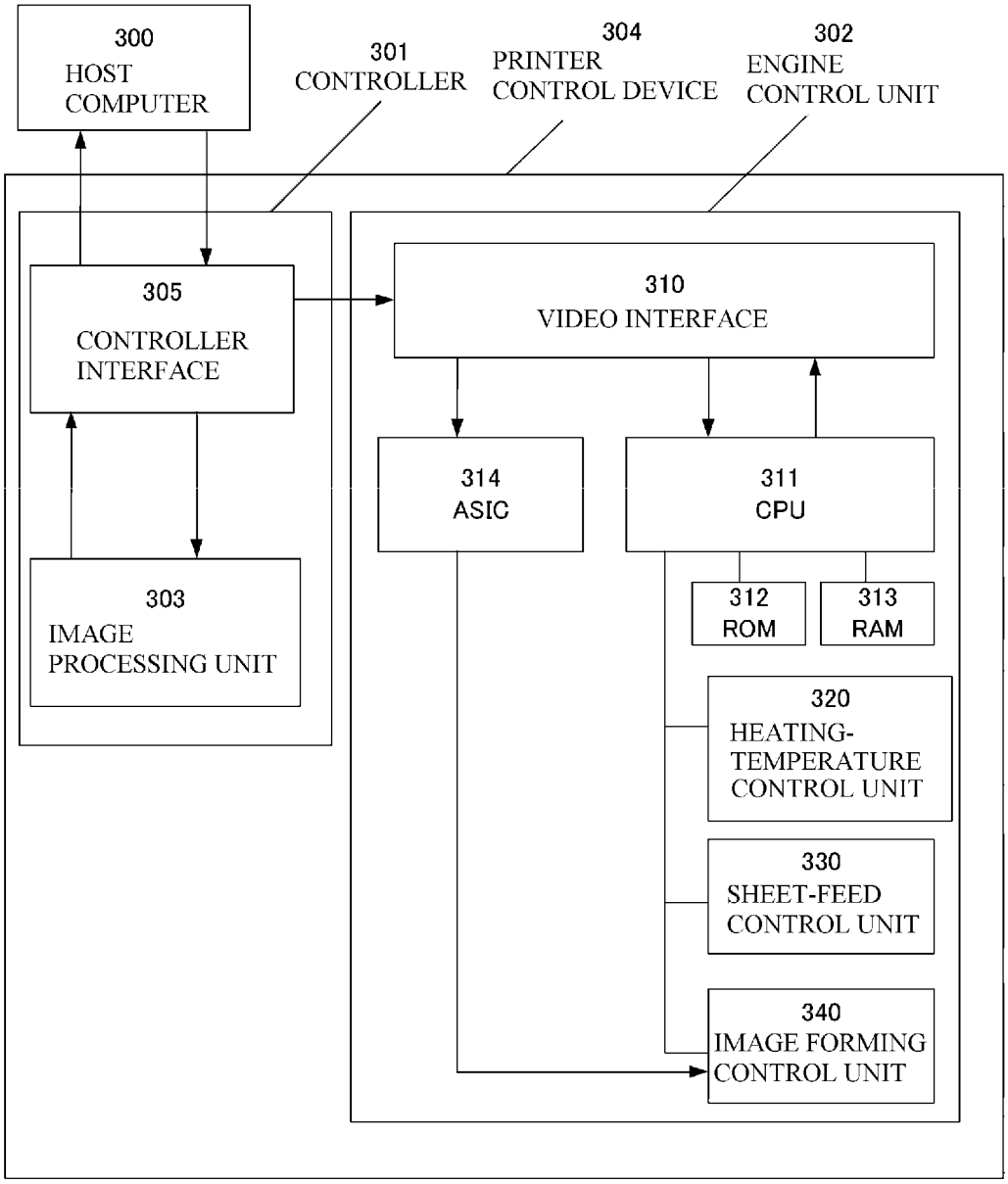
FIG. 3 is a block diagram illustrating functions of a printer control device.

A printer control device 304 will be described with reference to the block diagram illustrating the printer system configuration in FIG. 3. The printer control device 304 connects to and communicates with a host computer 300 using a controller interface 305. The printer control device 304 is largely made up of a controller unit 301 and an engine control unit 302. An image processing unit 303 of the controller unit 301 processes information received from the host computer 300 and generates image data, and transmits the generated image data to a video interface 310 of the engine control unit 302. Examples of information processing include bitmapping of text code, halftoning processing of grayscale images, and so forth.

Out of the information received by the engine control unit 302, information for lighting timing of the exposing device 3 is transmitted to an application specific integrated circuit (ASIC) 314. The ASIC 314 controls an image forming control unit 340 that performs operation control of the exposing device 3 and so forth.

Meanwhile, information relating to print mode and image size is transmitted to a central processing unit (CPU) 311. The CPU 311 performs temperature control of the heating device 100 by the heating-temperature control unit 320, operation interval control of the sheet feeding roller 4 by the sheet-feed control unit 330, process speed and developing/charging/transfer control by the image forming control unit 340, and so forth. The CPU 311 is connected to read-only memory (ROM) 312 and random access memory (RAM) 313, which are storage means. The CPU 311 performs various types of control processing by methods such as saving information to the RAM 313, reading out programs saved in the ROM 312 or the RAM 313, referencing information saved in the ROM 312 or the RAM 313, and so forth, as necessary.

Further, the controller unit 301 transmits print commands, cancel instructions, and so forth, to the engine control unit 302 in accordance with instructions performed by a user at the host computer, thereby controlling operations such as starting or cancelling printing operations or the like.

Heat Adjustment Control

The principal component of toner is resin, which softens under application of heat and readily adheres to material in contact therewith. This causes discharged-sheet sticking and image defects due thereto. Image defects due to discharged-sheet sticking readily occur in particular in cases where the temperature of sheets discharged and stacked on the discharge tray is high, or in cases where the adhesive force between the paper and the toner is weak (i.e., fixing performance is low).

Accordingly, in order to prevent discharged-sheet sticking in the present embodiment, the heat adjustment temperature is raised as the temperature of sheets discharged and stacked rises, thereby raising the sheet temperature immediately after passing the fixing nip, and raising fixing performance. Note that although the heat adjustment temperature is raised in the present embodiment to raise fixing performance, fixing performance can be raised by increasing the fixing pressure in stages to increase the fixing nip width, or by reducing the fixing speed in stages although productivity is reduced, or the like.

Figure 4:
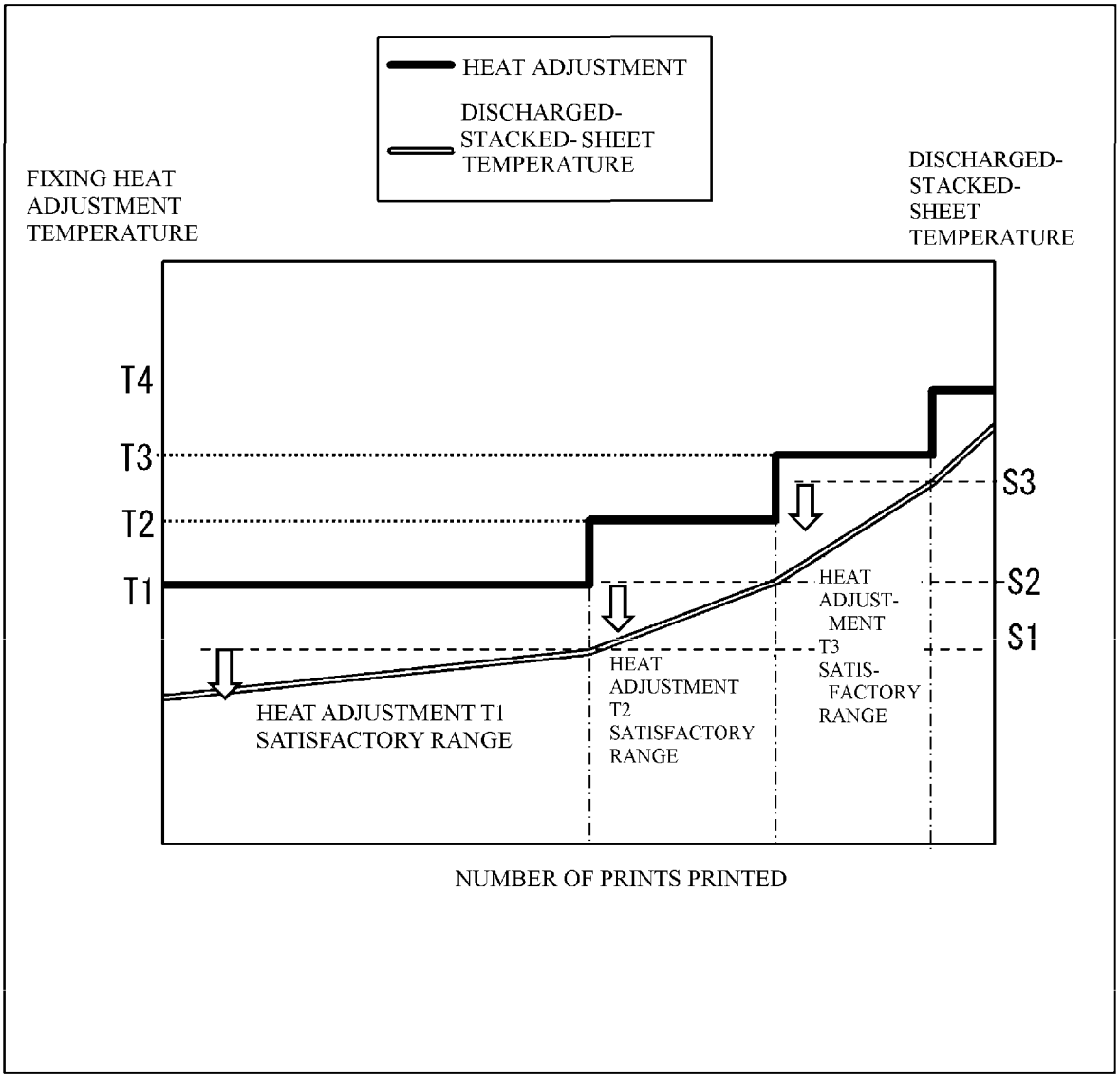
FIG. 4 is a diagram illustrating relation among number of sheets, heat adjustment temperature, and sheet temperature.

FIG. 4 shows heat adjustment control that is characteristic to the present embodiment. The horizontal axis represents the number of prints printed in the job, i.e., the number of times that the image forming operation is performed and a sheet is stacked on the discharge tray. The left-side vertical axis represents a heat adjustment temperature T, and setting values of the heat adjustment temperature increase in the order of T1, T2, T3, and T4, in stages as the number of prints being printed increases. The right-side vertical axis represents a discharged-stacked-sheet temperature S. The heating-temperature control unit 320 checks the discharged-stacked-sheet temperature S and switches the heat adjustment temperature T. That is to say, the discharged-stacked-sheet temperature S rises, as at a timing prior to reaching generated threshold-value temperatures S1, S2, S3, and an unshown S4 and so forth, the heat adjustment temperatures T1, T2, T3, and T4 and so forth corresponding to the respective generated threshold-value temperatures are switched to.

Figure 5:
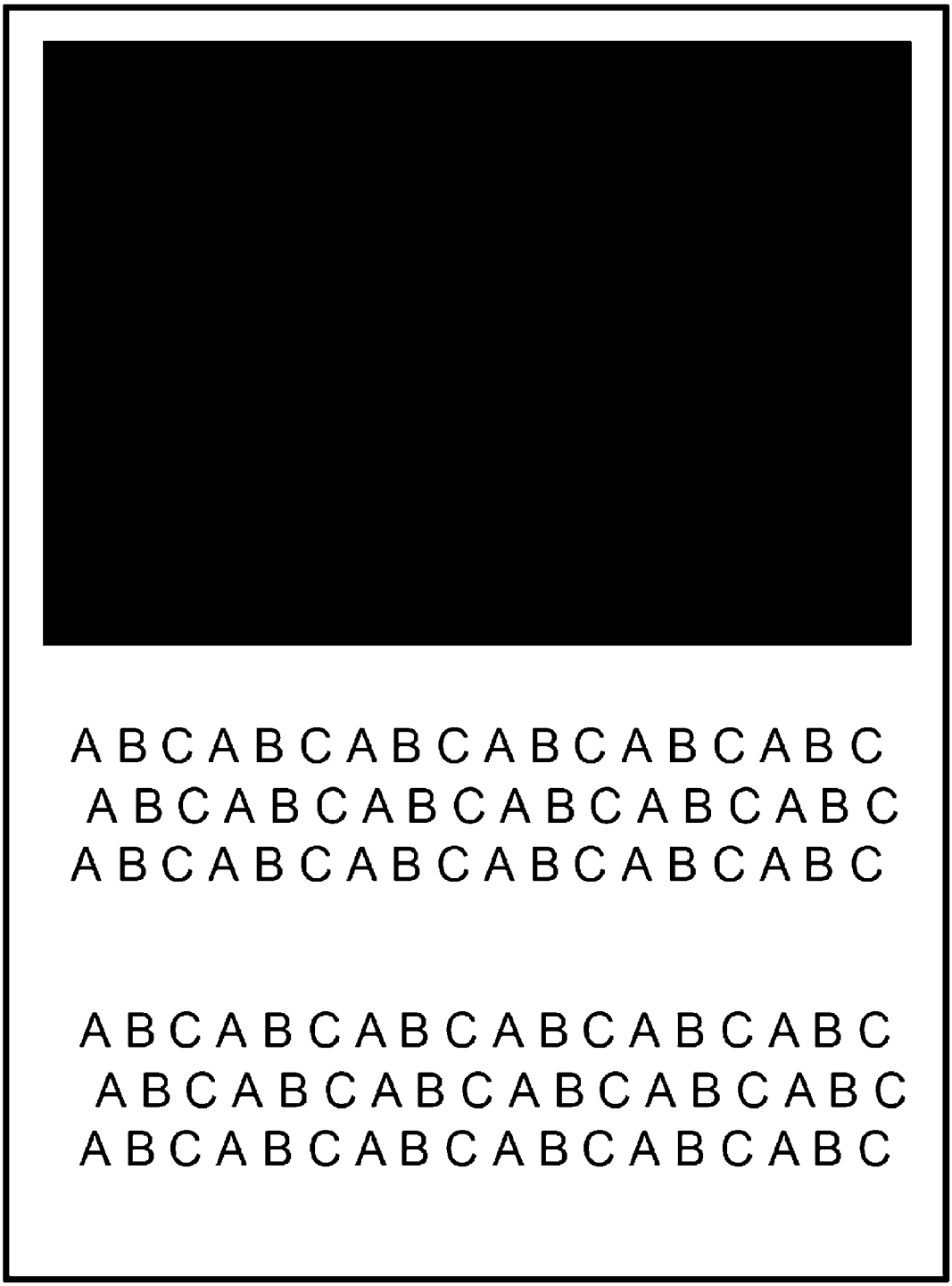
FIG. 5 is a diagram illustrating an image pattern used for testing.

Testing performed to obtain conditions for finding the values of the heat adjustment temperature T and the discharged-stacked-sheet temperature S will be described below. Automatic duplex continuous printing testing was performed at a plurality of heat adjustment temperatures, in order to decide setting values. In the print testing, the image pattern in FIG. 5 was printed continuously, and the discharged sheets were left standing in the stacked state. The sheets were allowed to cool for five minutes in that state, following which whether there was any discharged-sheet sticking was checked. The maximum number of prints successfully stacked without discharged-sheet sticking, and the temperature of the sheets stacked on the discharge tray at that time (discharged-stacked-sheet temperature S) were measured.

The testing was performed using sheets with grammage of 80 g/m$^2$ and A4 size (210 mm by 297 mm), which is a common laser-beam printer (LBP) printing sheet, under an environmental temperature of 23° C. A thermocouple (type K) applied to a sheet the same as that used for printing was used for measurement of the discharged-stacked-sheet temperature S. Immediately after the tenth sheet from the end of the number of prints to be printed was discharged, under various conditions, the aforementioned sheet with the thermocouple attached was placed thereupon and the temperature was measured. The thermocouple was disposed at a position 50 mm from the discharge outlet side wall face of the discharge tray.

Figure 6:
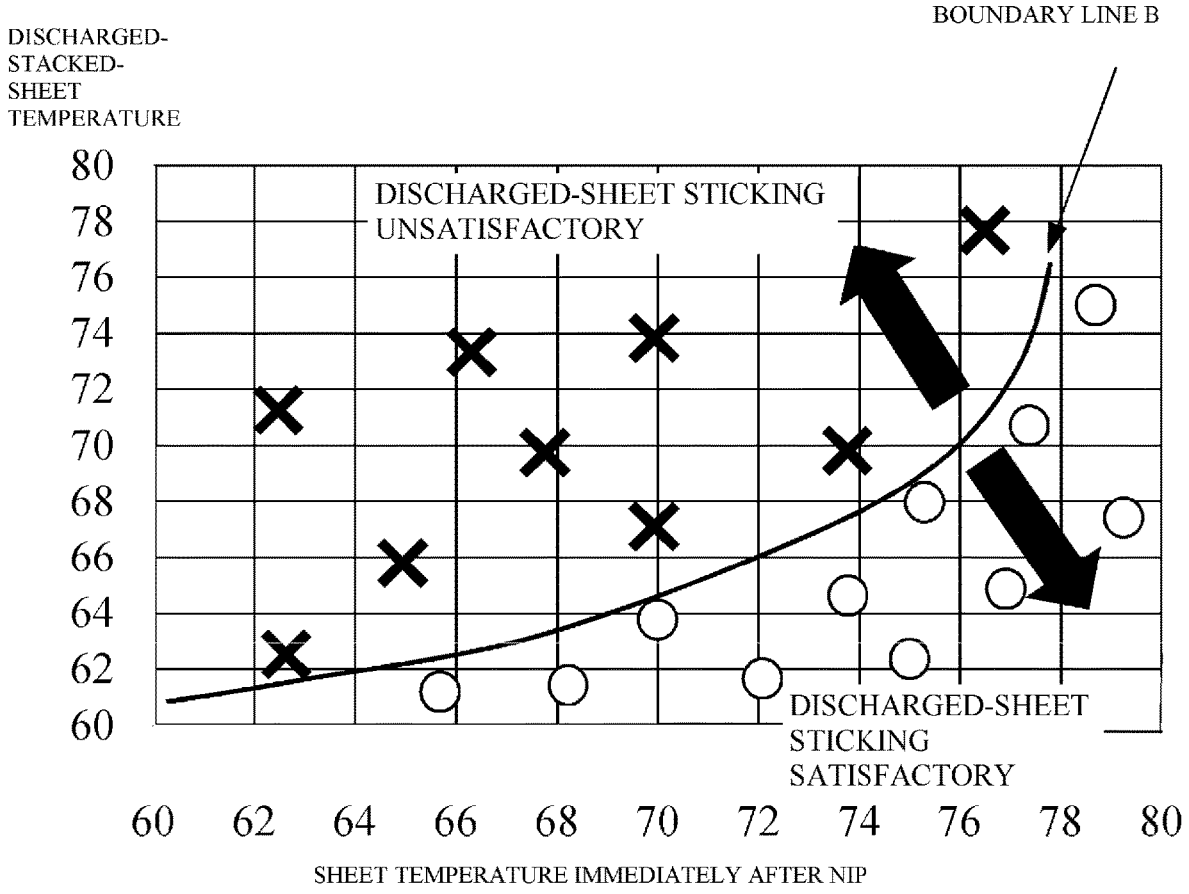
FIG. 6 is an explanatory diagram of a region in which discharged-sheet sticking occurs.

FIG. 6 is a graph illustrating the relation between the discharged-stacked-sheet temperature S, and the sheet temperature immediately after passing the fixing nip, and whether or not discharged-sheet sticking occurred. The sheet temperature immediately after passing the fixing nip was measured using a radiation thermometer (TMHX-CFE0350 (E), manufactured by Japan Sensor Corporation). In FIG. 6, the vertical axis represents the discharged-stacked-sheet temperature S, and the horizontal axis represents the sheet temperature immediately after passing the fixing nip. Plotted on the graph are cross marks that indicate cases where discharged-sheet sticking occurred (unsatisfactory), and circles that indicate cases where no discharged-sheet sticking occurred (satisfactory). A boundary line B between the circles and the crosses in FIG. 6 corresponds to the discharged-sheet sticking temperature threshold value in each sheet temperature immediately after passing the nip. Discharged-sheet sticking occurs in the region above the boundary line B, and no discharged-sheet sticking occurs in the region below the boundary line B. It can be seen from FIG. 6 that for the same sheet temperature immediately after passing the nip, a lower discharged-stacked-sheet temperature is good, and for the same discharged-stacked-sheet temperature, a higher sheet temperature immediately after passing the nip is good. Generally, if the sheet temperature immediately after passing the nip is high, and fixing performance is good, sticking tends not to occur even if the discharged-stacked-sheet temperature is high.

The setting values for the heat adjustment temperature in FIG. 4 are set such that the relation between the sheet temperature immediately after passing the nip and the discharged-stacked-sheet temperature are in the region of good conditions in FIG. 6. In the present embodiment, heat adjustment settings are in the range of 165° C. to 195° C., in a temperature range where there is no problem regarding image forming. Note that heat adjustment temperature settings are not performed outside of this range, since cold offset occurs at temperatures lower than 165° C., and image defects due to hot offset occur at temperatures higher than 195° C.

Figure 7:
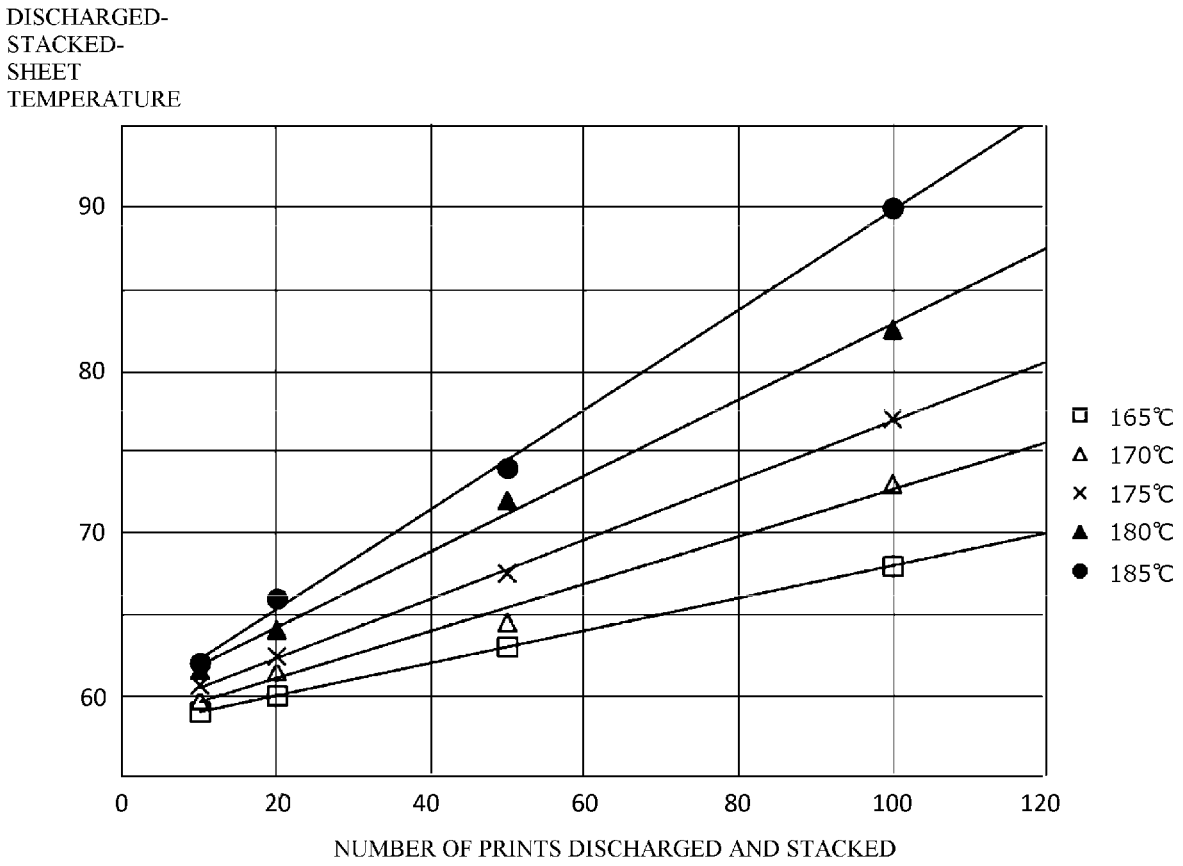
FIG. 7 is a diagram illustrating a relation between the number of discharged sheets that are stacked, and the temperature of the discharged and stacked sheets.

FIG. 7 shows the relation between the discharged-stacked-sheet temperature (maximum temperature at time of measurement) and the number of prints stacked, for each of cases with the heat adjustment temperature changed in increments of 5° C. in the range of 165° C. to 185° C., and sheets were passed and stacked. Table 1 shows the discharged-stacked-sheet temperature at which discharged-sheet sticking occurred (sticking temperature threshold value), and the number of prints successfully stacked without sticking.

TABLE 1

Table 1: Threshold value of discharged-sheet sticking temperature and number of prints successfully stacked

| HEAT ADJUSTMENT TEMPERATURE | NUMBER OF PRINTS | DISCHARGED-SHEET STICKING TEMPERATURE THRESHOLD VALUE |
|---|---|---|
| 165° C. | 50 | 63° C. |
| 170° C. | 52 | 65° C. |
| 175° C. | 30 | 70° C. |
| 180° C. | 48 | 74° C. |
| 185° C. | 50 | 76° C. |

Raising the heat adjustment temperature contributes to preventing discharged-sheet sticking from the perspective of raising the fixing performance of the toner, but at the same time contributes to occurrence of discharged-sheet sticking from the perspective of raising the discharged-stacked-sheet temperature. Accordingly, whether discharged-sheet sticking occurs or not is determined by the relation between fixing performance (temperature of sheet immediately after passing fixing nip) and the discharged-stacked-sheet temperature, and under the conditions in Table 1, occurs more readily at the time of heat adjustment temperature of 175° C. Also, fixing performance rises at heat adjustment temperature of 185° C., which is advantageous in preventing discharged-sheet sticking, but the effects are short-lasting due to the rise of the discharged-stacked-sheet temperature being fast. Accordingly, the heat adjustment temperature is raised in stages according to the number of prints printed in the present embodiment as illustrated in FIG. 4, thereby suppressing rise in the discharged-stacked-sheet temperature while ensuring fixing performance, so that discharged-sheet sticking does not occur.

The relation between the number of prints printed and the setting values for the heat adjustment temperature were decided as shown in Table 2 in the present embodiment, in light of the results of testing. A plurality of predetermined threshold values were set for the number of prints printed, and control was performed such that the heat adjustment temperature rises when the number of prints exceeds the threshold values. In deciding of this relation, the heat adjustment temperature was raised by 5° C. before the discharged-stacked-sheet temperature exceeded the threshold value. The heating-temperature control unit 320 changes the heat adjustment temperature when the counted number of prints printed reaches the set value, on the basis of a table saved in storage means in advance. Note that the heating-temperature control unit 320 may monitor and measure the discharged-stacked-sheet temperature by a radiation thermometer or the like, and perform heat adjustment control on the basis of the temperature.

TABLE 2

Table 2: Number of prints printed and heat adjustment temperature setting values

| HEAT ADJUSTMENT TEMPERATURE | NUMBER OF PRINTS | REFERENCE. DISCHARGED-STACKED-SHEET TEMPERATURE |
|---|---|---|
| 165° C. | 1~40 | 62° C. (40TH PRINT) |
| 170° C. | 41~58 | 65° C. (58TH PRINT) |
| 175° C. | 59~74 | 68° C. (74TH PRINT) |
| 180° C. | 75~90 | 72° C. (90TH PRINT) |
| 185° C. | 91~100 | 75° C. (100TH PRINT) |

Effects of Present Embodiment

Figure 8:
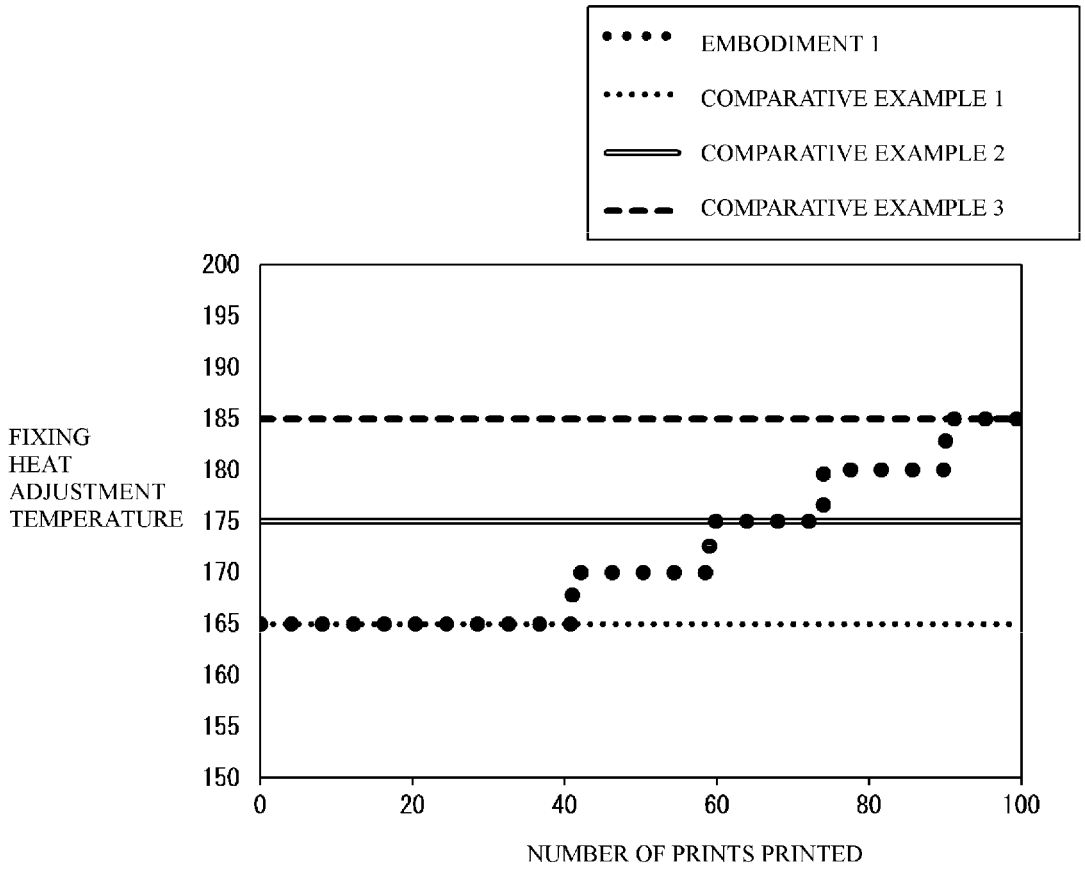
FIG. 8 is a diagram illustrating a relation between the number of prints and heat adjustment temperature according to control of an embodiment.

Effects of sticking prevention according to the present embodiment will be described with reference to comparative examples. FIG. 8 shows settings of heat adjustment control according to the present embodiment and comparative examples 1 through 3. The present embodiment is the heat adjustment control in stages in accordance with the number of prints printed, shown in Table 2. The comparative examples 1 through 3 are constant-temperature heat adjustment control at 165° C., 175° C., and 185° C., respectively, regardless of the number of prints printed.

Table 3 shows the results of evaluating discharged-sheet sticking of the embodiment and comparative examples. Cases where no sticking occurred are indicated by circles, and cases where sticking occurred are indicated by crosses. Embodiment 1 had the greatest number of prints successfully stacked, with no discharged-sheet sticking occurring even after 100 prints were stacked. The number of prints successfully stacked was 50 prints at heat adjustment temperature of 165° C. in comparative example 1, 30 prints at heat adjustment temperature of 175° C. in comparative example 2, and 50 prints at heat adjustment temperature of 185° C. in comparative example 3. It was this confirmed that effects of preventing sticking are obtained by raising the heat adjustment temperature in stages in accordance with the number of prints, as in the present embodiment.

TABLE 3

Table 3: Discharged-sheet sticking evaluation results

| DISCHARGED-SHEET STICKING | 30 PRINTS STACKED | 50 PRINTS STACKED | 80 PRINTS STACKED | 100 PRINTS STACKED |
|---|---|---|---|---|
| EMBODIMENT 1 | ○ | ○ | ○ | ○ |
| COMPARATIVE EXAMPLE 1 | ○ | ○ | X | X |
| COMPARATIVE EXAMPLE 2 | ○ | X | X | X |

TABLE 3-continued

Table 3: Discharged-sheet sticking evaluation results

| DISCHARGED-SHEET STICKING | 30 PRINTS STACKED | 50 PRINTS STACKED | 80 PRINTS STACKED | 100 PRINTS STACKED |
|---|---|---|---|---|
| COMPARATIVE EXAMPLE 3 | ○ | ○ | X | X |

Although the effects were confirmed in the present embodiment for duplex printing in which discharged-sheet sticking occurs particularly readily, sticking prevention effects are manifested in simplex printing as well.

Embodiment 2

Next, Embodiment 2 will be described. Description will be simplified in the present embodiment regarding apparatus configurations and control contents that are the same as in Embodiment 1. In the present embodiment, temperature control is performed in accordance with image pattern analysis results of faces of each of a preceding sheet and a following sheet that come into contact with each other, in addition to the temperature control performed in accordance with the number of prints printed, in continuous automatic duplex printing, thereby preventing sticking between the preceding sheet and the following sheet.

Image Analysis

Image analysis according to the present embodiment will be described. The image processing unit 303 according to the present embodiment performs image processing on image data received from the host computer 300, such as halftoning of grayscale images or the like, in the same way as in Embodiment 1. Parallel with this image processing, analysis of image data is performed in the present embodiment, and printing ratio information is calculated. The heating-temperature control unit 320 then decides the heat adjustment temperature (temperature of the heating heater 113) in accordance with the printing ratio information.

The method of calculating the heat adjustment temperature from the image data will be described. The image processing unit 303 divides the image into a plurality of regions in the direction of transportation of the recording material P, and calculates the average printing ratio for each region. The heat adjustment temperature is then decided for the recording material P, in accordance with the portion of which the average printing ratio is the highest.

Analysis of Image Printing Ratio

The method of analyzing the image data of A4-size recording material P will be described by way of example of FIG. 9. The image processing unit 303 divides the recording material P into four in the transportation direction, into region 1 through region 4, analyzes the image data in each region, and calculates the average printing ratio. Specifically, the image processing unit 303 accumulates density data for each pixel over each region. A state in which a region is completely filled by pixels of maximum density (density 100%) is a printing ratio of 100%, and a state in which there is no image formed in a region is printing ratio 0%.

Figure 9:
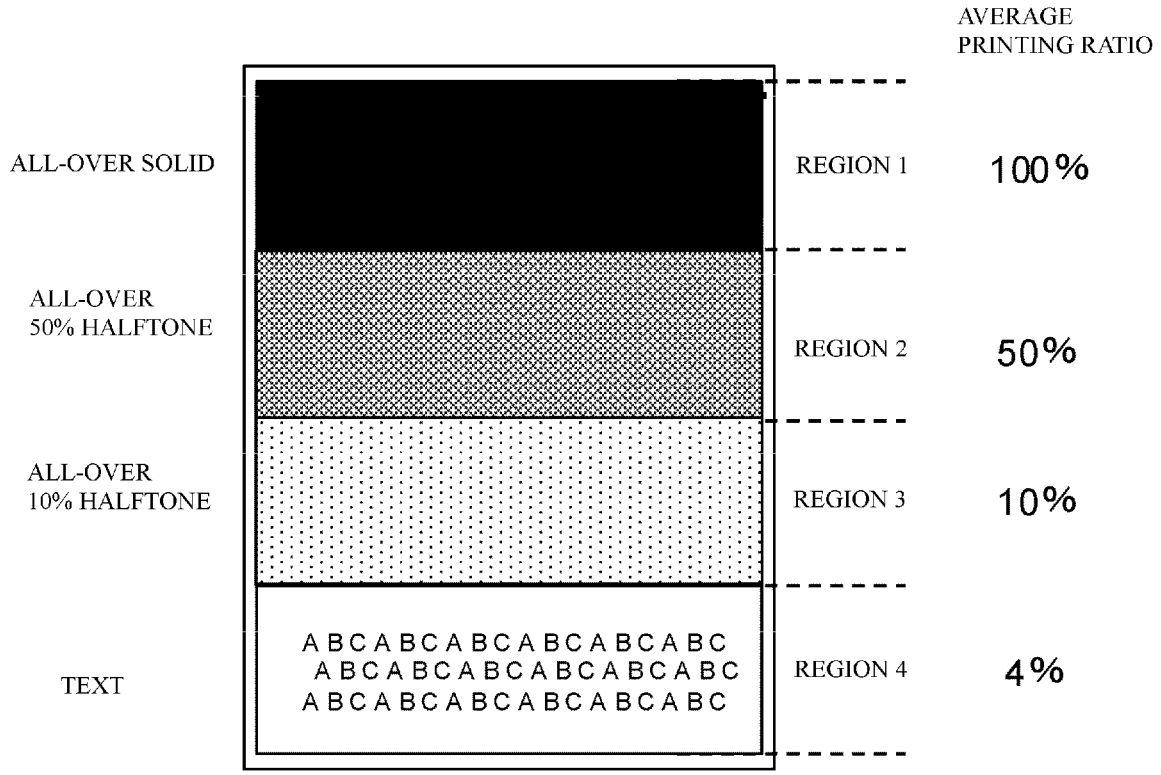
FIG. 9 is a diagram illustrating the way in which an image is divided into a plurality of regions.

In FIG. 9, region 1 is solid black, with the entire region filled in with 100% density, and accordingly the printing ratio is 100%. Region 2 is filled in with 50% density, and region 3 is filled in with 10% density, and accordingly the respective average printing ratios are 50% and 10%. Text is drawn in region 4 at 100% density, and the text coverage area is 4% of region 4, and accordingly the average printing ratio is 4%. Note that even with color image forming apparatuses that use toners of a plurality of colors, the average printing ratio can be calculated by calculating the printing ratio for each piece of image data obtained by color separation, and averaging the printing ratios.

Heat Adjustment Settings

Figure 10A:
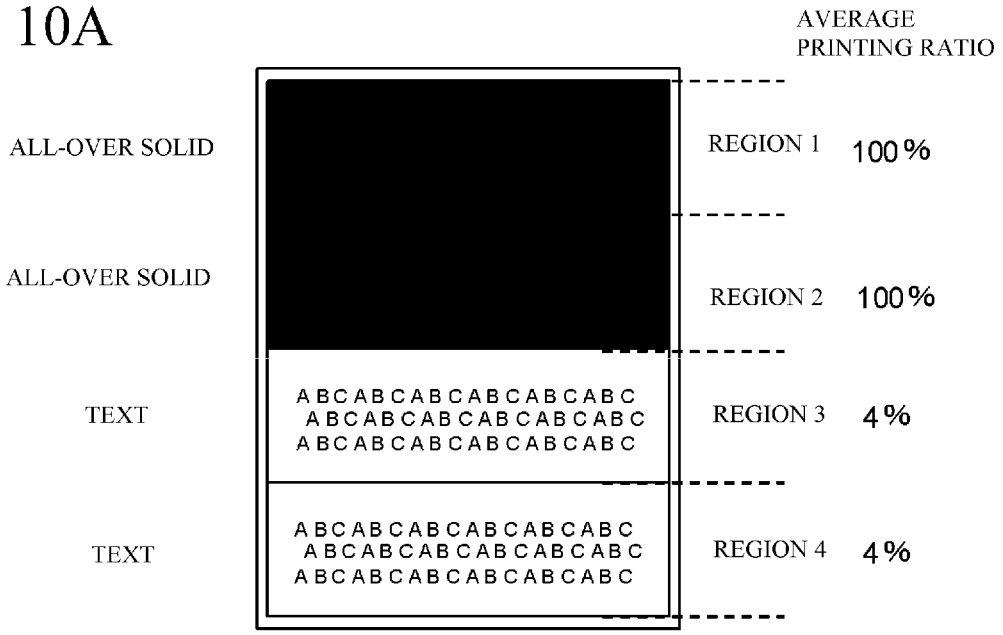
FIGS. 10A and 10B are diagrams for describing the relation between average printing ratio and discharged-sheet sticking for each region.
Figure 10B:
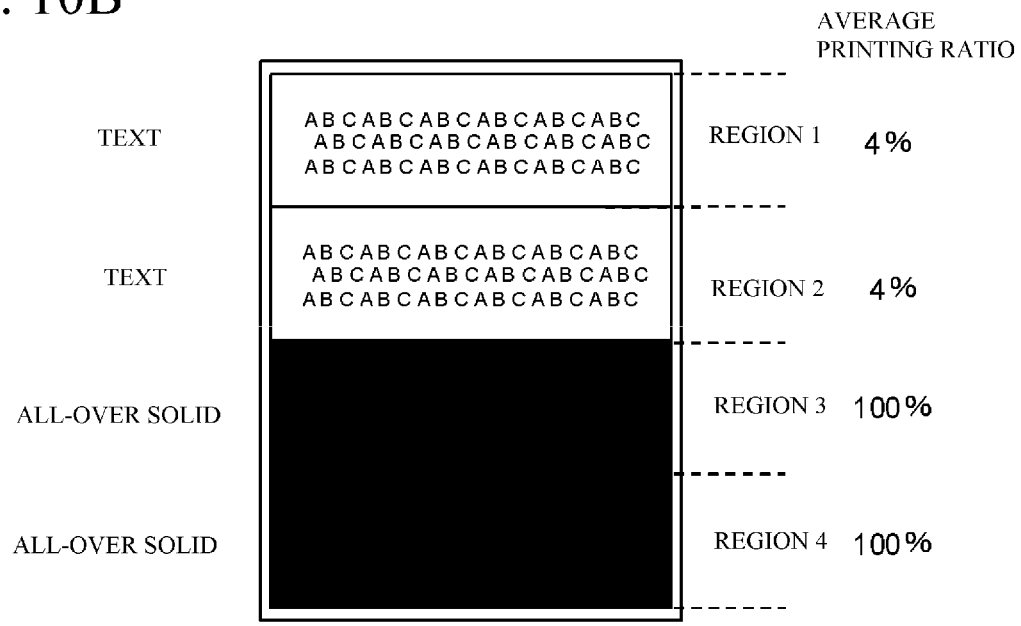

In a case of performing continuous printing with automatic duplex printing, sticking readily occurs in a case in which the printing ratio is high in both regions that come into contact with each other in the discharge tray 45. For example, a case will be assumed in which FIG. 10A is a first print (rear face, first face) of a preceding sheet (first recording material), and FIG. 10B is a second print (front face, second face that comes into contact with the first face of the preceding sheet) of a following sheet (second recording material). In this case, the all-over solid black region of the preceding sheet comes into contact with the text region of the following sheet, while the text region of the preceding sheet comes into contact with the all-over solid black region of the following sheet, and accordingly, sticking does not readily occur. Conversely, if both the first face of the preceding sheet and the second face of the following sheet have an image pattern such as in FIG. 10A, the solid black regions that have a high average printing ratio come into contact with each other, and accordingly sticking of the preceding sheet and the following sheet occurs readily.

Accordingly, the image processing unit 303 analyzes the image pattern on face A of the preceding sheet and the image pattern on face B of the following sheet, and determines whether or not there is mutual contact of regions with high average printing ratios between the preceding sheet and the following sheet. Heat adjustment correction is then performed in accordance with whether or not there is such contact, thereby preventing sticking between the preceding sheet and the following sheet. Also, rise in the discharged-stacked-sheet temperature is suppressed, further improving sticking prevention capabilities.

Figure 11:
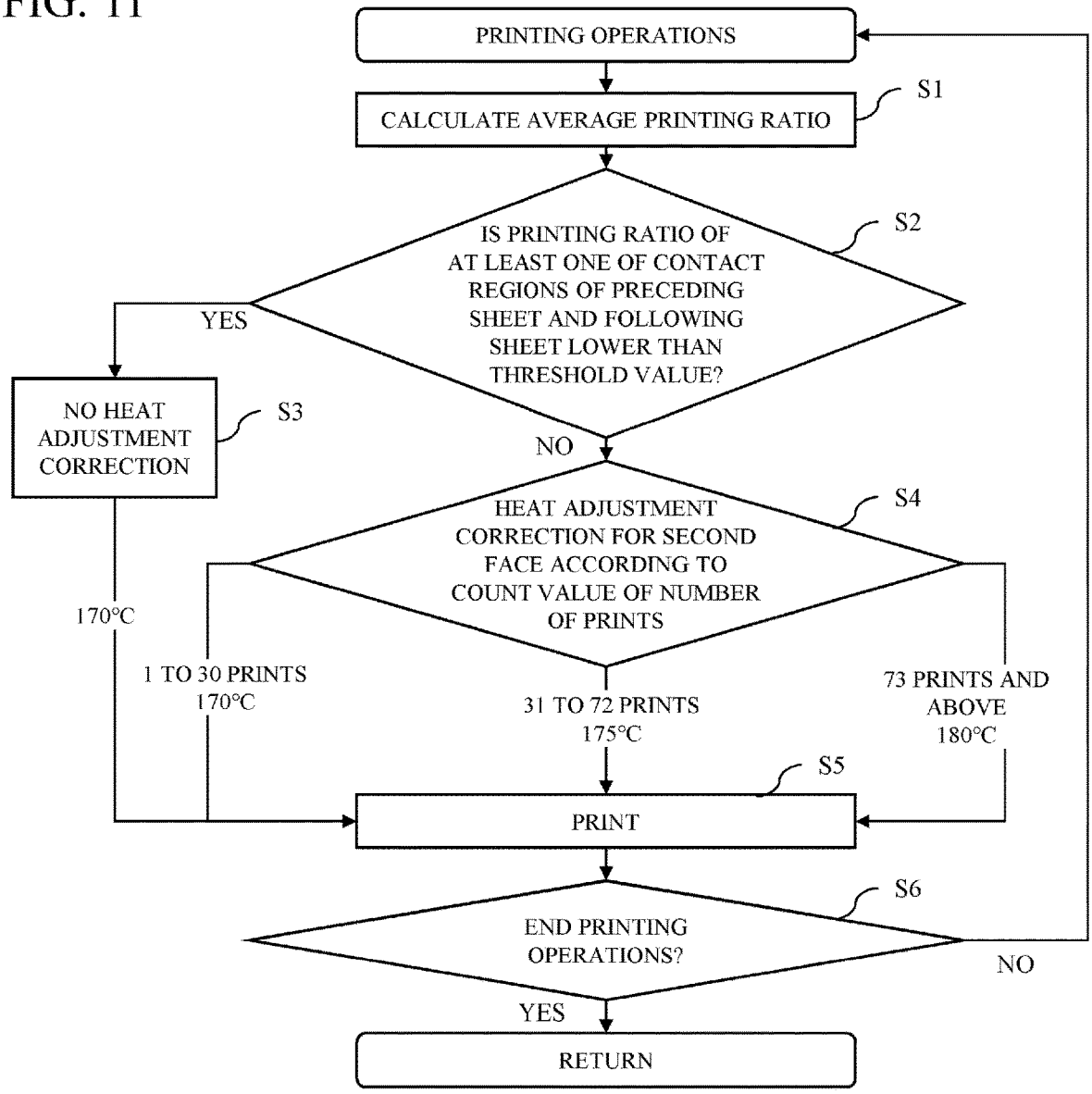
FIG. 11 is a flowchart for describing processing of Embodiment 2.

FIG. 11 shows a flowchart of heat adjustment control in image forming operations according to the present embodiment. Upon printing operations starting, in step S1, the image processing unit 303 analyzes image data on face A of a preceding sheet and face B of a following sheet before the following sheet is fed at the latest, and calculates the average printing ratio for each of the four regions divided into in the transportation direction.

In step S2, determination is made regarding whether or not the average printing ratio is below a threshold value in at least one of regions of the preceding sheet and the following sheet that may come into contact with each other on the discharge tray. The average printing ratio serving as a threshold value here (printing ratio threshold value) is 40%. If this condition is satisfied (YES in S2), discharged-sheet sticking will not readily occur. Accordingly, the flow advances to step S3, the heat adjustment is set to 170° C. with no temperature adjustment correction performed for the following sheet, and advances to printing processing. Conversely, in a case where comparison between regions on face A of the preceding sheet and face B of the following sheet that will come into contact with each other shows that there is a region in which the average printing ratio is no lower than the threshold value in both (NO in S2), the flow advances to step S4.

In step S4, the heating-temperature control unit 320 performs heat adjustment correction in accordance with the count of the number of prints in the job. Heat adjustment correction was performed as control in a case where heat adjustment correction is necessary for all image patterns. Specifically, in this control, the temperature was set to 170° C. for the first through 30th prints, to 175° C. for the 31st through 72nd prints, and to 180° C. for the 73rd print and thereafter. Note that for heat adjustment settings, heat adjustment correction for the preceding sheet may be made in accordance with the number of prints printed in the job, regardless of the average printing ratio. Then in step S5, printing is executed at the heat adjustment temperature that is decided.

Analyzing the image pattern on face A of the preceding sheet and the image pattern on face B of the following sheet and deciding the heat adjustment control for the following sheet, as in the present embodiment, enables sticking between the preceding sheet and the following sheet to be prevented, while avoiding unnecessary rise in sheet temperature, and accordingly a great number of sheets can be stacked.

Effects of Present Embodiment

Figure 12:
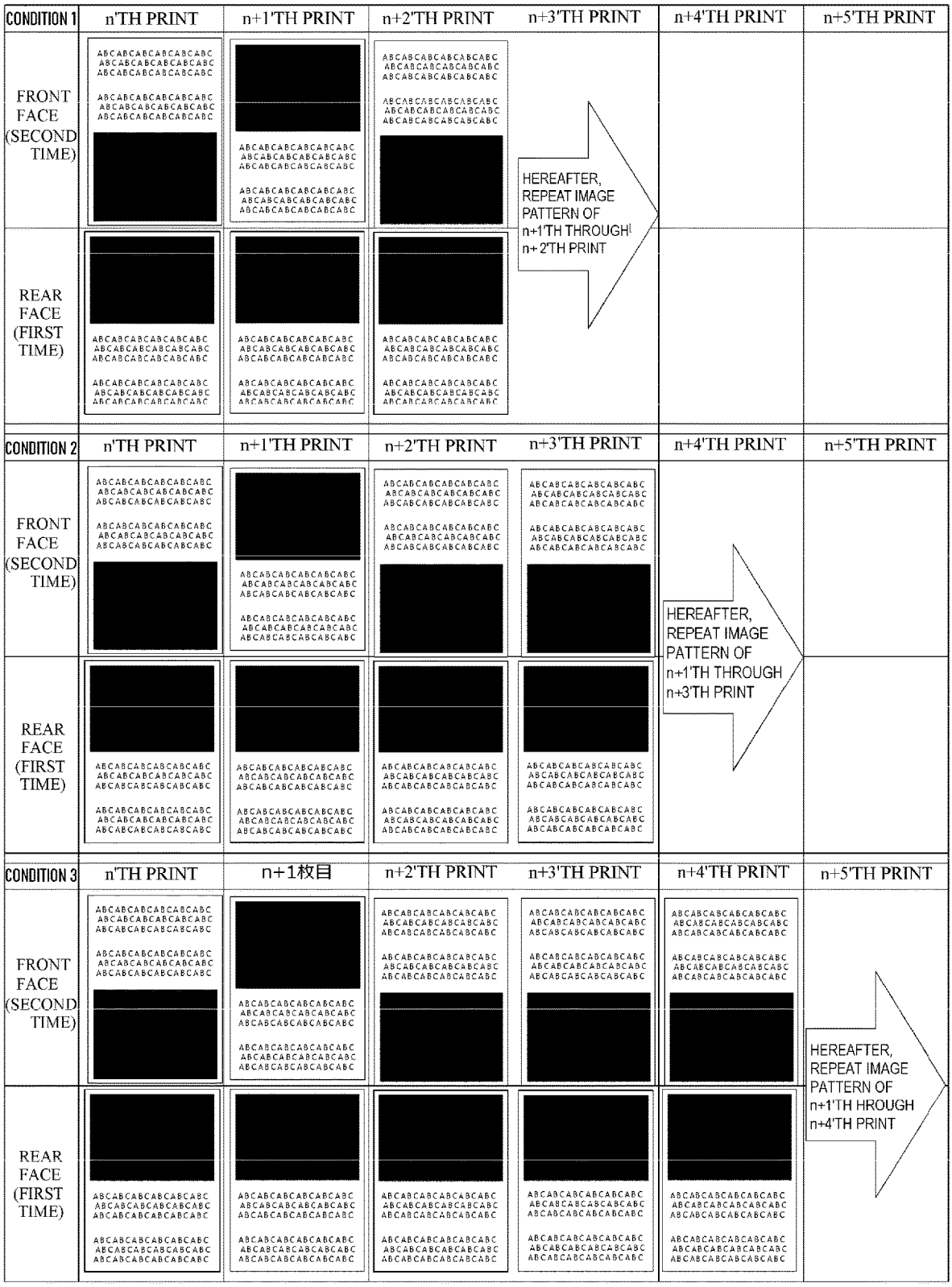
FIG. 12 is a diagram for describing conditions regarding combined image patterns according to Embodiment 2.

FIG. 12 shows image patterns used in comparative experiments to confirm the effects of the present embodiment. Hereinafter, a combination regarding which determination is made that heat adjustment correction is necessary between the preceding sheet and the following sheet on the basis of the average printing ratios will be referred to as "A", and a combination regarding which heat adjustment correction is not necessary will be referred to as "B". The following three types of conditions are set here.

Condition 1: printing where alternating combinations A and B continues (ABAB . . . )

Condition 2: printing where one time of combination A occurs and two times of combination B continues (ABBABB . . . )

Condition 3: printing where one time of combination A occurs and three times of combination B continues (ABBBABBB . . . )

Table 4 shows the results of performing continuous printing under each of the conditions, and confirming the discharged-stacked-sheet temperature at the time of stacking 100 prints, and the number of prints successfully stacked without sticking.

TABLE 4

Table 4: Results of Embodiment 2

| | PRINTING PATTERN | NUMBER OF PRINTS SUCCESSFULLY STACKED | DISCHARGED-STAKED-SHEET TEMPERATURE WHEN 100 PRINTS STACKED |
|---|---|---|---|
| CONDITION 1 OF EMBODIMENT 2 | A B A B . . . | 140 | 75° C. |
| COMPARATIVE EXAMPLE 1 | A B A B . . . | 118 | 79° C. |
| CONDITION 2 OF EMBODIMENT 2 | A B B A B B . . . | 153 | 71° C. |
| COMPARATIVE EXAMPLE 2 | A B B A B B . . . | 118 | 79° C. |
| CONDITION 3 OF EMBODIMENT 2 | A B B B A B B B . . . | 178 | 68° C. |
| COMPARATIVE EXAMPLE 3 | A B B B A B B B . . . | 118 | 80° C. |

The confirmation results of the comparative examples 1 through 3 are also listed in Table 4. The comparative examples 1 through 3 each have the same image patterns as condition 1 through condition 3, but are cases in which heat adjustment settings according to the above-described flow in accordance with the image patterns are not performed, and heat adjustment settings are performed only on the basis of the number of prints printed. Specifically, in the comparative examples 1 through 3, all heat adjustment settings were 170° C. for 1 to 30 sheets, 175° C. for 31 to 72 sheets, and 180° C. for 73 sheets and thereafter, for both faces.

Comparing condition 1 with comparative example 1, condition 2 with comparative example 2, and condition 3 with comparative example 3, the discharged-stacked-sheet temperature when 100 prints are discharged and stacked is lower than the comparative examples, and a greater number were successfully stacked for each of the conditions as compared with the comparative examples. Also, comparing among the conditions 1, 2, and 3 showed that the number of prints successfully stacked was great in the order of condition 3>condition 2>condition 1, and the discharged-stacked-sheet temperature when 100 prints are discharged and stacked was high in the order of condition 1>condition 2>condition 3. That is to say, it can be seen that discharged-sheet sticking occurs least readily under condition 3 in which there are more of combination "B", and the effects of the present embodiment are great. This is due to control of raising the heat adjustment temperature (heat adjustment correction) in accordance with the number of prints printed being unnecessary for the combination "B".

From the above, it can be seen that the effects of heat adjustment correction according to the present embodiment are manifested under any of the conditions, but discharged-sheet sticking occurs least readily if there are many prints of image patterns in the job that do not need heat adjustment correction in accordance with the number of prints printed. Accordingly, it was confirmed that the effects are more pronounced by performing heat adjustment correction only in cases where necessary. Note that while heat adjustment temperature settings of the second face are adjusted in Embodiment 2, the same effects can be obtained in a case of performing correction for the first face only, as well. Also, the number of regions to be divided into, the dividing method, temperature settings, the degree of correction, and other such conditions can be set as appropriate in accordance with apparatus configurations and capabilities.

Embodiment 3

Next, Embodiment 3 will be described. Description will be simplified in the present embodiment regarding apparatus configurations and control contents that are the same as in the above embodiments. In the present embodiment, the sheet temperature immediately after passing the fixing nip is raised in accordance with the environmental temperature and the number of prints printed in the job, thereby preventing sticking of preceding sheets and following sheets.

Detection of Environment

Figure 13:
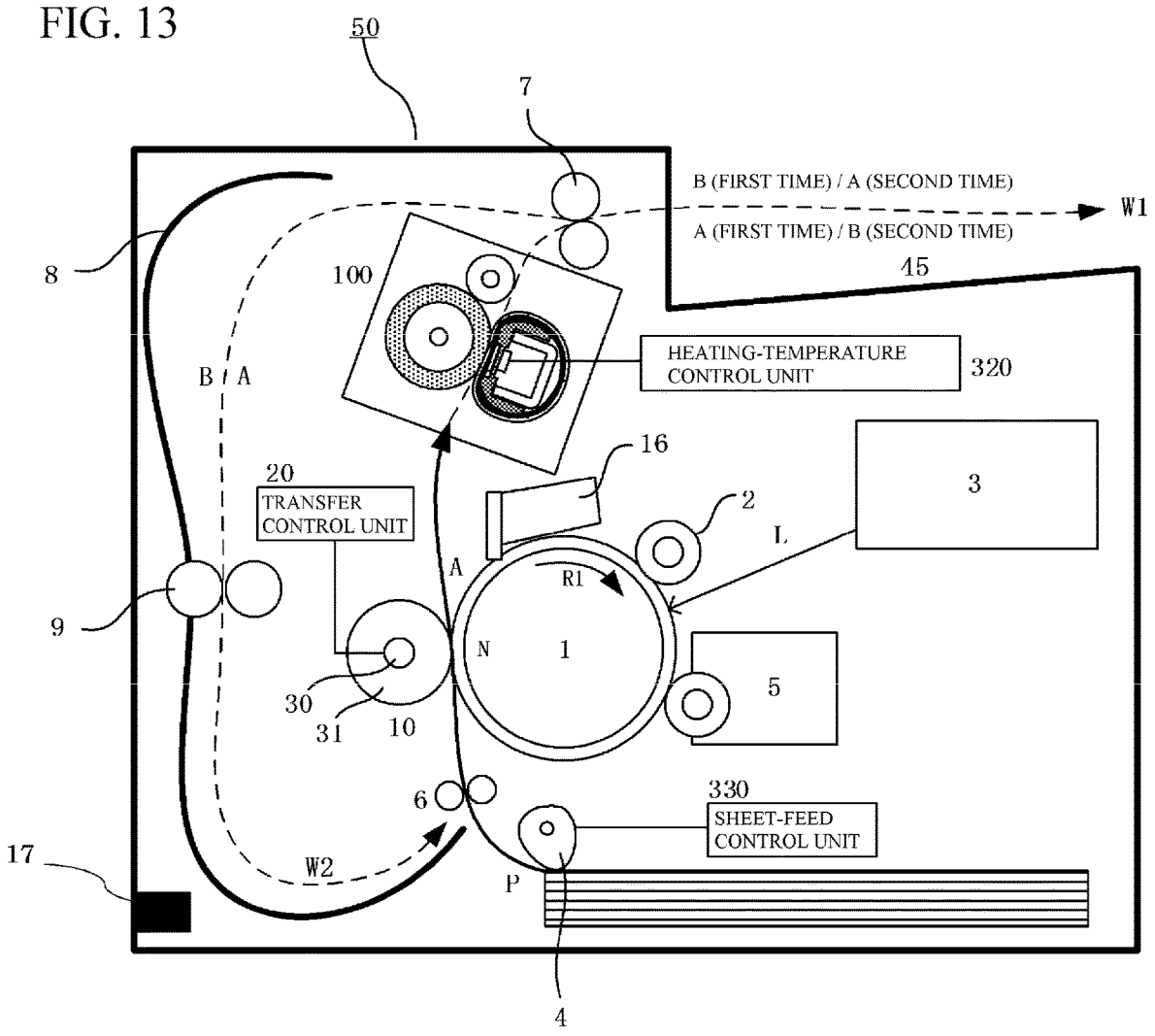
FIG. 13 is a cross-sectional view illustrating a configuration of an image forming apparatus according to Embodiment 3.

The image forming apparatus according to the present embodiment is provided with an environment sensor 17, as illustrated in FIG. 13. An environmental temperature detecting thermistor is used as the environment sensor 17 here. Electrical environment detection information from the environment sensor 17 is input to the engine control unit 302 via an A/D converter that is omitted from illustration. The engine control unit 302 performs control on the basis of environment detection information input from the environment sensor 17.

Heat Adjustment Settings

Now, the discharged-stacked-sheet temperature changes depending on the environmental temperature. Accordingly, the timing of performing heat adjustment correction in accordance with the number of prints printed is changed depending on the environmental temperatures in the present embodiment. Specifically, under a high-temperature environment, the timing for switching is quickened, and under a low-temperature environment, the timing for switching is delayed.

Figure 14A:
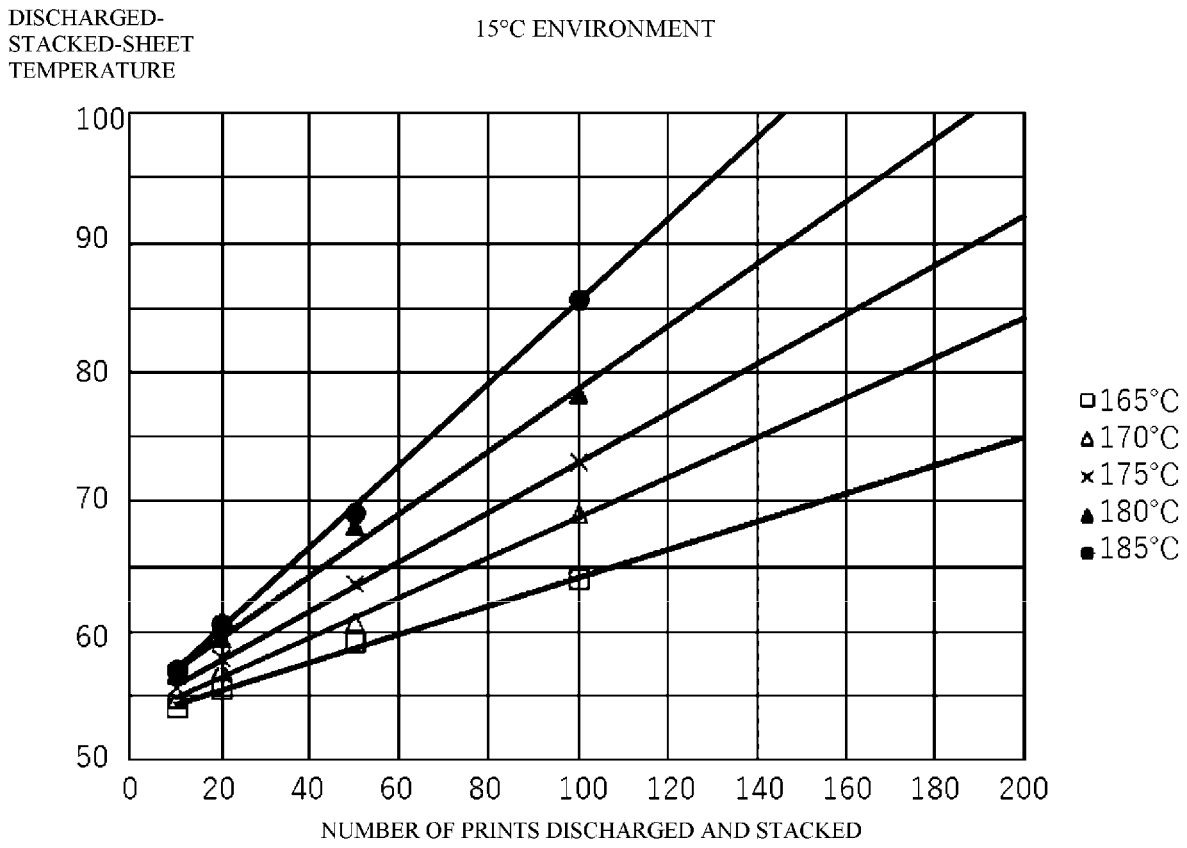
FIG. 14A is a diagram illustrating the relation between the number of prints stacked and sheet temperature according to Embodiment 3.
Figure 14B:
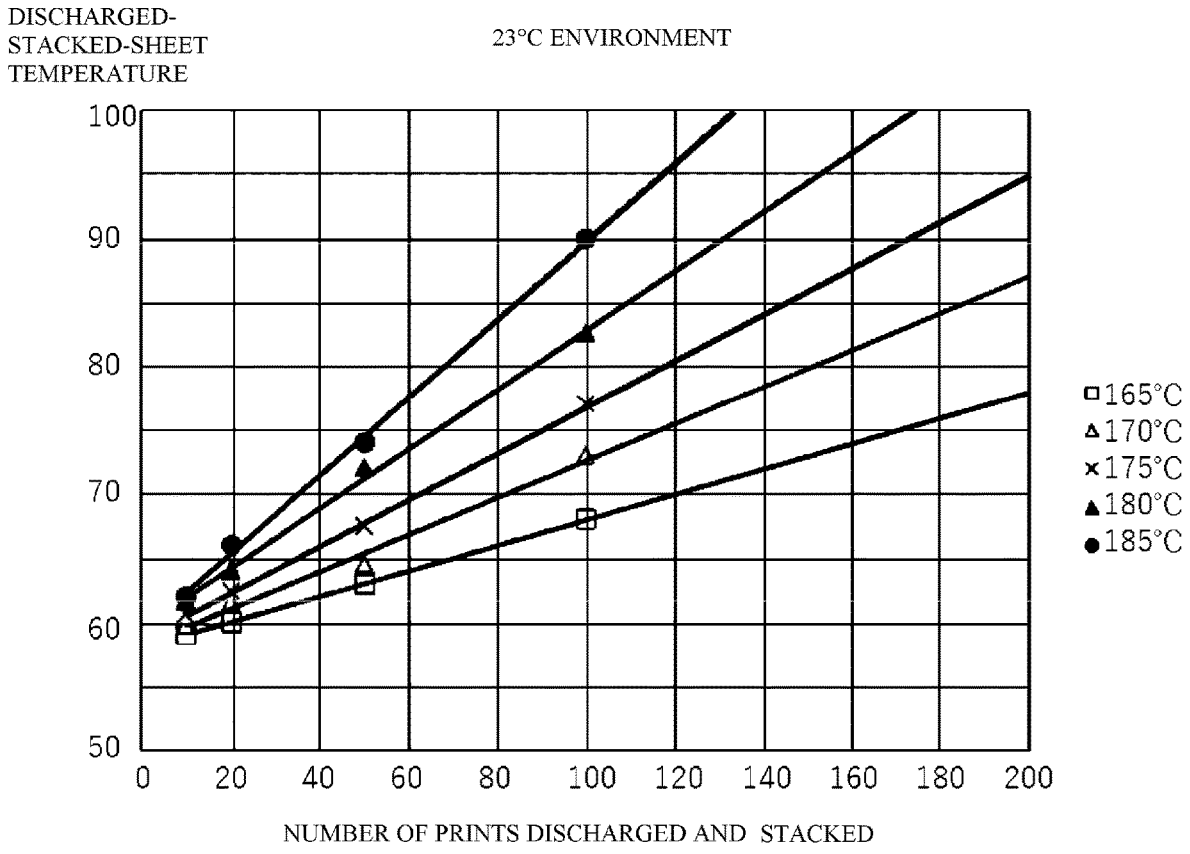
FIG. 14B is a diagram illustrating the relation between the number of prints stacked and sheet temperature according to Embodiment 3 under a different environmental temperature.
Figure 14C:
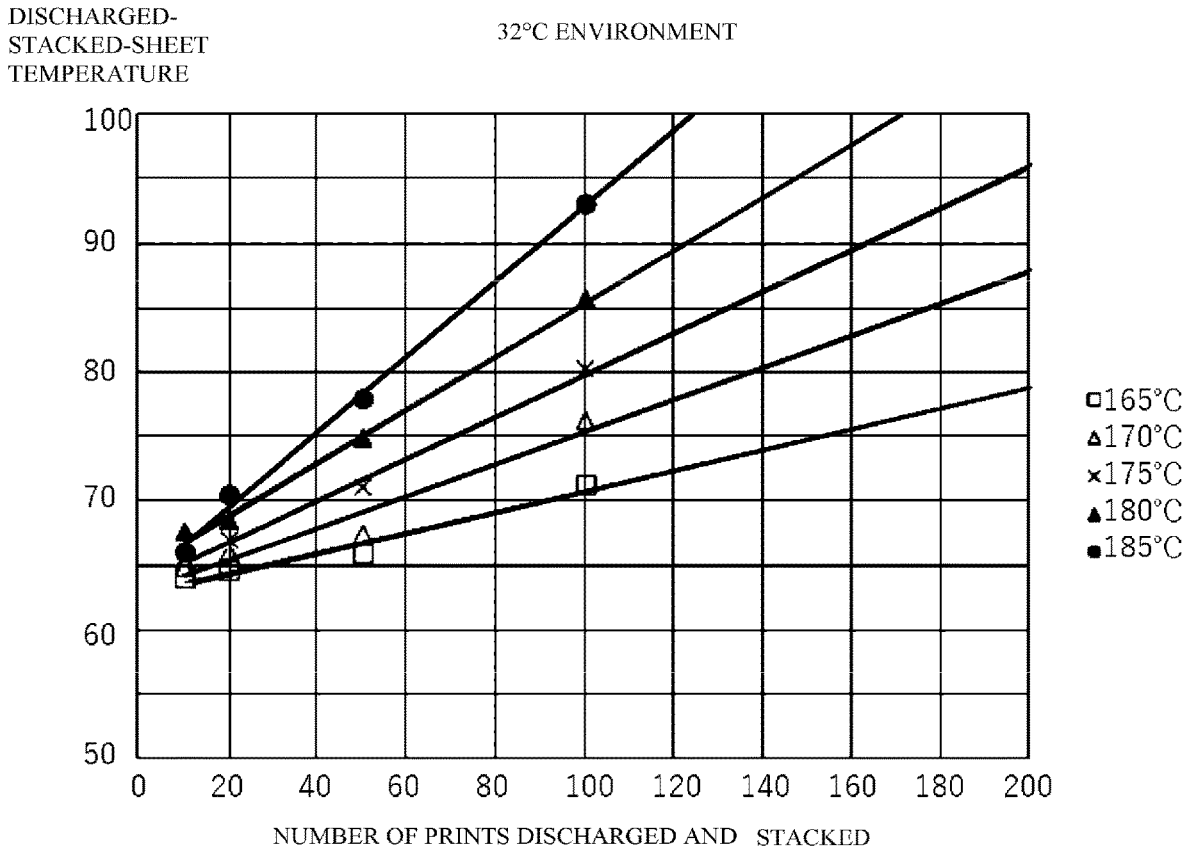
FIG. 14C is a diagram illustrating the relation between the number of prints stacked and sheet temperature according to Embodiment 3 under a different environmental temperature.

In the present embodiment, automatic duplex continuous printing testing was performed while changing heat adjustment temperature conditions according to the same method as in Embodiment 1, and setting values were decided for each environmental temperature. Testing was performed regarding temperatures, for each of low temperature (15° C.), normal temperature (23° C.), and high temperature (32° C.). FIGS. 14A through 14C represent the relation between the discharged-stacked-sheet temperature (maximum temperature at time of measurement) and the number of prints stacked for each environmental temperature, respectively corresponding to low temperature, normal temperature, and high temperature. Table 5 shows the discharged-stacked-sheet temperature at which discharged-sheet sticking occurred (sticking temperature threshold value), and the number of prints that were stacked without sticking, for each environmental temperature. It can be seen from these that the higher the environmental temperature is, the higher the discharged-stacked-sheet temperature tends to be.

TABLE 5

Table 5: Environmental temperature and prints successfully stacked for each heat adjustment temperature

| HEAT ADJUSTMENT TEMPERA-TURE | NUMBER OF PRINTS SUCCESSFULLY DISCHARGED AND STACKED | | | DISCHARGED-STACKED-SHEET TEMPERATURE |
|---|---|---|---|---|
| | 15° C. | 23° C. | 32° C. | |
| 165° C. | 80 | 50 | 10 | 63° C. |
| 170° C. | 78 | 52 | 18 | 65° C. |
| 175° C. | 82 | 30 | 39 | 70° C. |
| 180° C. | 80 | 48 | 41 | 74° C. |
| 185° C. | 70 | 50 | 40 | 76° C. |

In light of the above results, the heat adjustment settings such as shown in Table 6 (environmental temperature 15° C.), Table 7 (environmental temperature 23° C.), and Table 8 (environmental temperature 32° C.) were made in the present embodiment. In each environmental temperature here, the heat adjustment temperature was set to be raised by 5° C. before the discharged-stacked-sheet temperature exceeded the threshold value.

TABLE 6

Table 6: Number of prints printed and heat adjustment temperature setting values under 15° C. environment

| HEAT ADJUSTMENT TEMPERATURE | NUMBER OF PRINTS | REFERENCE: DISCHARGED-STACKED-SHEET TEMPERATURE |
|---|---|---|
| 165° C. | 1~80 | 62° C. (80TH PRINT) |
| 170° C. | 81~98 | 65° C. (98TH PRINT) |
| 175° C. | 99~112 | 68° C. (112TH PRINT) |
| 180° C. | 113~128 | 72° C. (128TH PRINT) |
| 185° C. | 129~138 | 75° C. (138TH PRINT) |

TABLE 7

Table 7: Number of prints printed and heat adjustment temperature setting values under 23° C. environment

| HEAT ADJUSTMENT TEMPERATURE | NUMBER OF PRINTS | REFERENCE. DISCHARGED-STACKED-SHEET TEMPERATURE |
|---|---|---|
| 165° C. | 1~40 | 62° C. (40TH PRINT) |
| 170° C. | 41~58 | 65° C. (58TH PRINT) |
| 175° C. | 59~74 | 68° C. (74TH PRINT) |
| 180° C. | 75~90 | 72° C. (90TH PRINT) |
| 185° C. | 91~100 | 75° C. (100TH PRINT) |

TABLE 8

Table 8: Number of prints printed and heat adjustment temperature setting values under 32° C. environment

| HEAT ADJUSTMENT TEMPERATURE | NUMBER OF PRINTS | REFERENCE: DISCHARGED-STACKED-SHEET TEMPERATURE |
|---|---|---|
| 165° C. | 1~9 | 62° C. (9TH PRINT) |
| 170° C. | 10~20 | 65° C. (20TH PRINT) |
| 175° C. | 21~36 | 68° C. (36TH PRINT) |
| 180° C. | 37~59 | 72° C. (59TH PRINT) |
| 185° C. | 60~72 | 75° C. (72ND PRINT) |

Effects of Present Embodiment

Testing was performed regarding heat adjustment settings in Tables 6 to 8 under each of the environmental temperatures, to confirm the effects of the present embodiment. The pattern in FIG. 5 was continuously printed in the present embodiment, in the same way as in Embodiment 1. The sheets were allowed to cool for five minutes in the discharged and overlaid state, following which whether there was any discharged-sheet sticking of recording material was checked. As a comparative example to serve as an object of comparison, the environmental temperature was set to the high-temperature environment of 32° C. but the temperature switching timing was set to the same as for the case of 23° C.

Table 9 shows the effects confirmation results. No sticking occurred in the cases of environmental temperatures of 15° C. and 23° C. Also, the number of prints successfully stacked reached 80 prints even for the case of environmental temperature of 32° C. In contrast, the number of prints successfully stacked with the comparative example was ten prints. Accordingly, the number of prints successfully stacked was increased even under a high-temperature environment, by quickening the switching timing of heat adjustment temperature, as illustrated in Table 8 of the present embodiment. Also, no sticking occurred even with the switching timing delayed for low temperature (environmental temperature of 15° C.) as compared to normal temperature (environmental temperature of 23° C.), and it was confirmed that discharged-sheet sticking does not occur at low temperatures even if the switching timing is delayed.

TABLE 9

Table 9: Results of confirmation of effects of present embodiment

| STICKING | 10 PRINTS STACKED | 30 PRINTS STACKED | 50 PRINTS STACKED | 80 PRINTS STACKED | 100 PRINTS STACKED |
|---|---|---|---|---|---|
| EMBODIMENT 3 15° C. CONDITIONS | ○ | ○ | ○ | ○ | ○ |
| EMBODIMENT 3 23° C. CONDITIONS | ○ | ○ | ○ | ○ | ○ |
| EMBODIMENT 3 32° C. CONDITIONS | ○ | ○ | ○ | ○ | X |
| COMPARATIVE EXAMPLE 32° C. | ○ | X | X | X | X |

The present embodiment is even more effective when control is performed combined with printing ratio information as in Embodiment 2.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132267, filed Aug. 4, 2020, which is hereby incorporated by reference wherein in its entirety.

What is claimed is:

1. An image forming apparatus comprising:

an image forming unit that forms a toner image on a recording material;

a fixing unit that heats the recording material and fixes the toner image onto the recording material;

a recording material stacking unit, on which the recording material, for which an image forming operation of forming the toner image and fixing the toner image onto the recording material has been performed, is stacked; and a heating-temperature control unit that controls a temperature of the fixing unit, wherein in a case where the image forming apparatus performs the image forming operation a plurality of times, the heating-temperature control unit performs control such that the temperature of the fixing unit is a first temperature when the image forming operation is performed a first number of times and that the temperature of the fixing unit is a second temperature when the image forming operation is performed a second number of times, the second number of times is greater than the first number of times, and the second temperature is higher than the first temperature, and a temperature of the recording material stacked on the recording material stacking unit when the image forming operation is performed the second number of times is higher than the temperature of the recording material stacked on the recording material stacking unit when the image forming operation is performed the first number of times.

2. The image forming apparatus according to claim 1, wherein the heating-temperature control unit performs control of raising the temperature of the fixing unit when heating the recording material, in accordance with an increase in the number of sheets of the recording material stacked on the recording material stacking unit.

3. The image forming apparatus according to claim 2, wherein the heating-temperature control unit performs control of raising the temperature of the fixing unit when heating the recording material when the number of sheets of the recording material stacked on the recording material stacking unit exceeds a predetermined threshold value.

4. The image forming apparatus according to claim 1, wherein the heating-temperature control unit performs control of raising the temperature of the fixing unit when heating the recording material, in accordance with a rise in the temperature of the recording material stacked on the recording material stacking unit.

5. The image forming apparatus according to claim 4, wherein the heating-temperature control unit performs control of raising the temperature of the fixing unit when heating the recording material, before the temperature of the recording material stacked on the recording material stacking unit exceeds a threshold temperature.

6. The image forming apparatus according to claim 5, wherein the threshold temperature is decided on the basis of a temperature which is measured in advance and at which the recording material stacked on the recording material stacking unit sticks.

7. The image forming apparatus according to claim 1, further comprising an image processing unit that analyzes image data for forming the toner image, wherein the heating-temperature control unit performs temperature control of the fixing unit in accordance with an analysis result of the image processing unit.

8. The image forming apparatus according to claim 7, wherein the image forming operation is performed on both a first face and a second face of the recording material, when the first face of a first recording material to be stacked on the recording material stacking unit and the second face of a second recording material to be stacked on the recording material stacking unit subsequent to the first recording material come into contact, the image processing unit analyzes image data for forming images on the first face of the first recording material and on the second face of the second recording material, and calculates an average printing ratio, and the heating-temperature control unit performs control of raising the temperature of the fixing unit in a case where the average printing ratios of the first face of the first recording material and the second face of the second recording material both exceed a printing ratio threshold value.

9. The image forming apparatus according to claim 8, wherein the image processing unit divides the recording material into a plurality of regions in a transportation direction, and performs analysis for each of the regions.

10. The image forming apparatus according to claim 1, further comprising an environmental temperature detecting unit that detects an environmental temperature, wherein the heating-temperature control unit changes temperature control of the fixing unit when heating the recording material, in accordance with the environmental temperature.

11. The image forming apparatus according to claim 10, wherein the higher the environmental temperature is, the quicker the heating-temperature control unit raises the temperature of the fixing unit.

* * * * *